US010281228B1

(12) United States Patent
Marfione

(10) Patent No.: US 10,281,228 B1
(45) Date of Patent: May 7, 2019

(54) SUPPRESSOR FOR A FIREARM

(71) Applicant: Microtech Knives, Inc., Bradford, PA (US)

(72) Inventor: Anthony Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 15/964,194

(22) Filed: Apr. 27, 2018

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/325
See application file for complete search history.

(56) References Cited

U.S. PATENT DOCUMENTS 4,291,610 A * 9/1981 Waiser ..... F41A 21/30 89/14.4
4,576,083 A * 3/1986 Seberger, Jr. ..... F01N 1/08 181/223
4,588,043 A 5/1986 Finn
4,920,854 A 5/1990 Scanlon
5,029,512 A 7/1991 Latka
5,164,535 A * 11/1992 Leasure ..... F41A 21/30 181/223
5,559,302 A 9/1996 Latka
6,575,074 B1 6/2003 Gaddini
7,832,323 B1 * 11/2010 Davies ..... F41A 21/30 89/14.4
7,931,118 B1 4/2011 Cronhelm
8,100,224 B1 * 1/2012 Olson ..... F41A 21/30 181/212
8,272,306 B1 * 9/2012 Smith ..... F41A 21/30 181/223
8,387,299 B1 * 3/2013 Brittingham ..... F41A 21/30 42/90

(Continued)

FOREIGN PATENT DOCUMENTS

DE 1553874 A1 * 10/1971 ..... F41A 21/30
DE 202014004278 U1 * 7/2014 ..... F41A 21/30
EP 2587209 A2 * 5/2013 ..... F41A 21/30

OTHER PUBLICATIONS

Machine Translation of DE-1553874-A1 to Kaestner (Year: 2018).*

*Primary Examiner* — Joshua T Semick
(74) *Attorney, Agent, or Firm* — Steve LeBlanc, LLC

(57) ABSTRACT

A suppressor for a firearm includes a casing having rear and front ends. Baffles are inside the casing between the rear and front ends. A cylindrical support has an upstream end, a downstream end, and a circumferential rib. The upstream end is connected to the rear end of the casing. The downstream end is engaged with at least one of the baffles. The circumferential rib surrounds the cylindrical support between the upstream and downstream ends and extends radially from the cylindrical support to the casing. Upstream and downstream annular chambers defined at least in part by the casing, the cylindrical support, and the circumferential rib circumferentially surround the cylindrical support. A plurality of apertures through the cylindrical support provide fluid communication through the cylindrical support to the upstream and downstream annular chambers.

19 Claims, 5 Drawing Sheets

(56) References Cited

U.S. PATENT DOCUMENTS

| | | | | |
|---|---|---|---|---|
| 8,424,441 | B2 * | 4/2013 | Brittingham | F41A 21/30 181/223 |
| 8,511,425 | B2 * | 8/2013 | Larue | F41A 21/36 181/223 |
| 8,950,310 | B2 * | 2/2015 | Storrs | F41A 21/30 181/223 |
| 9,470,466 | B2 | 10/2016 | Washburn, III et al. | |
| 9,746,267 | B2 * | 8/2017 | Smith | F41A 21/30 |
| 2012/0152649 | A1 | 6/2012 | Larue | |

* cited by examiner

SUPPRESSOR FOR A FIREARM

FIELD OF THE INVENTION

The present invention generally involves a suppressor for a firearm.

BACKGROUND OF THE INVENTION

A conventional firearm operates by combusting gunpowder or other accelerant to generate combustion gases that propel a projectile through a barrel and out of the muzzle. The rapidly expanding combustion gases exit the muzzle to produce a characteristic loud bang commonly associated with gunfire.

A suppressor (also commonly referred to as a silencer) is a device attached to the muzzle of the firearm to dissipate energy of the combustion gases to reduce the noise signature of the firearm. The suppressor generally includes a number of baffles serially arranged or stacked inside a casing. A longitudinal pathway through the baffle stack allows the projectile to pass through the suppressor unobstructed, while the baffle stack redirects the combustion gases inside the casing to allow the combustion gases to expand, cool, and otherwise dissipate energy before exiting the suppressor. The combustion gases thus exit the suppressor with less energy, reducing the noise signature associated with the discharge of the firearm.

While numerous suppressor designs exist to reduce the noise signature of a firearm, the need exists for continued improvements that further reduce the noise signature of a firearm. In particular, improvements in conditioning the combustion gases before reaching the baffle stack may enhance the expansion, cooling, and/or energy dissipation of the combustion gases passing through the suppressor, reducing the noise signature associated with the discharge of the firearm.

BRIEF DESCRIPTION OF THE INVENTION

Aspects and advantages of the invention are set forth below in the following description, or may be obvious from the description, or may be learned through practice of the invention.

One embodiment of the present invention is a suppressor for a firearm. The suppressor includes a casing, a plurality of baffles inside the casing, and means for releasably attaching the suppressor to the firearm. A cylindrical support has an upstream end connected to the casing and a downstream end engaged with at least one baffle of the plurality of baffles. A circumferential rib surrounds and extends radially from the cylindrical support. An upstream annular chamber defined at least in part by the casing, the cylindrical support, and the circumferential rib circumferentially surrounds the cylindrical support. A downstream annular chamber defined at least in part by the casing, the cylindrical support, and the circumferential rib circumferentially surrounds the cylindrical support downstream from the upstream annular chamber. A plurality of apertures through the cylindrical support provide fluid communication through the cylindrical support to the upstream and downstream annular chambers.

An alternate embodiment of the present invention is a suppressor for a firearm that includes a casing having a rear end disposed opposite from a front end. A plurality of baffles are inside the casing between the rear and front ends. A cylindrical support has an upstream end, a downstream end, and a circumferential rib. The upstream end is connected to the rear end of the casing. The downstream end is engaged with at least one baffle of the plurality of baffles. The circumferential rib surrounds the cylindrical support between the upstream and downstream ends and extends radially from the cylindrical support to the casing. An upstream annular chamber defined at least in part by the casing, the cylindrical support, and the circumferential rib circumferentially surrounds the cylindrical support. A downstream annular chamber defined at least in part by the casing, the cylindrical support, and the circumferential rib circumferentially surrounds the cylindrical support downstream from the upstream annular chamber. A plurality of apertures through the cylindrical support provide fluid communication through the cylindrical support to the upstream and downstream annular chambers.

In yet another embodiment of the present invention, a suppressor for a firearm includes a casing having a rear end disposed opposite from a front end. A plurality of baffles are inside the casing between the rear and front ends. A cylindrical support has an upstream end, a downstream end, and a circumferential rib. The upstream end is connected to the rear end of the casing. The downstream end is engaged with at least one baffle of the plurality of baffles. The circumferential rib surrounds the cylindrical support between the upstream and downstream ends and extends radially from the cylindrical support to the casing. An upstream annular chamber defined at least in part by the casing, the cylindrical support, and the circumferential rib circumferentially surrounds the cylindrical support. A downstream annular chamber defined at least in part by the casing, the cylindrical support, and the circumferential rib circumferentially surrounds the cylindrical support downstream from the upstream annular chamber. A plurality of apertures through the cylindrical support provide fluid communication through the cylindrical support to the upstream and downstream annular chambers. A plurality of passages between the circumferential rib and the casing provide fluid communication between the upstream and downstream annular chambers. A plurality of axially extending grooves disposed circumferentially around an outer surface of the downstream end of the cylindrical support provide fluid communication from the downstream annular chamber to the plurality of baffles.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
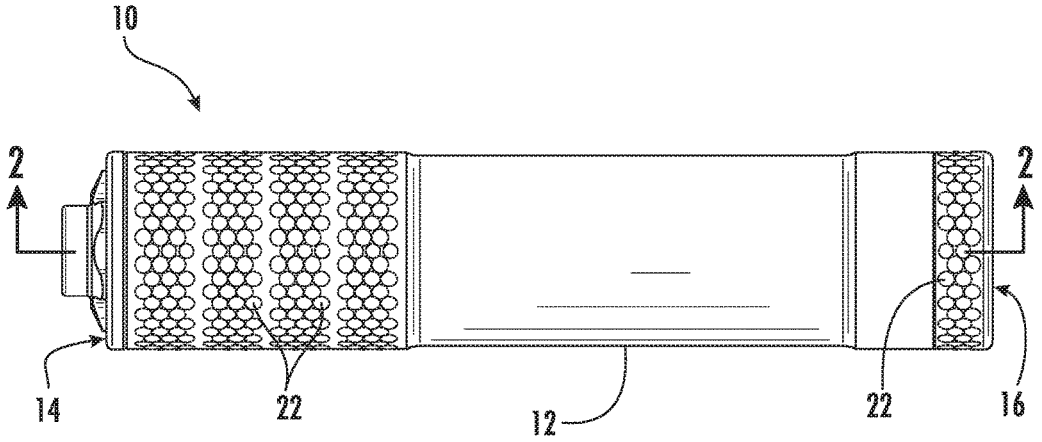
FIG. 1 is a side plan view of a suppressor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. As used herein, the term "axial" refers to a direction of flow through an object; the term "radial" refers to a direction extending away from the center of an object or normal to the "axial" direction, and the term "circumferential" refers to a direction extending around the circumference or perimeter of an object.

Figure 2:
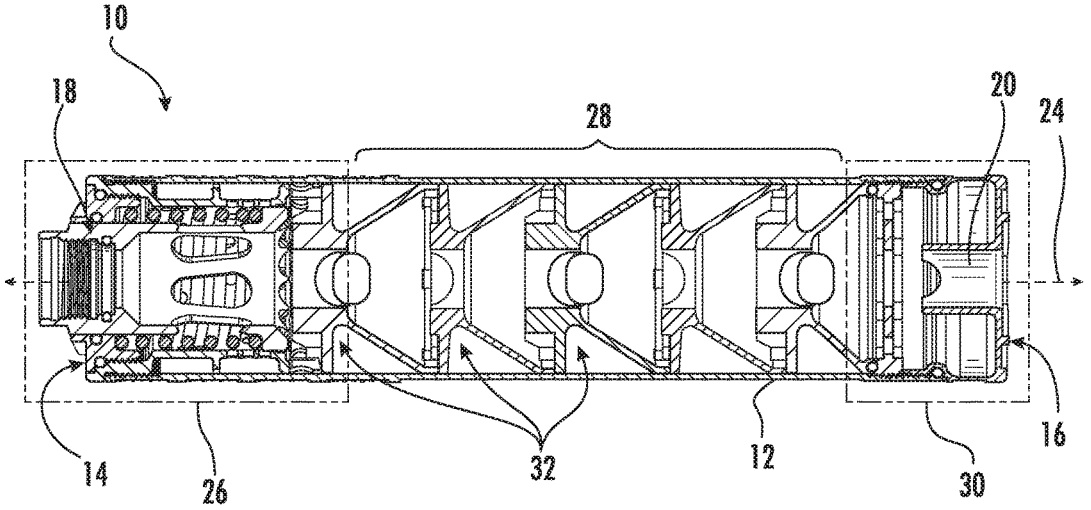
FIG. 2 is a side cross-section view of the suppressor shown in FIG. 1 taken along line 2-2.

Embodiments of the present invention provide a suppressor for a firearm with improved sound damping and/or thermal performance compared to existing suppressor designs. FIG. 1 provides a side plan view of a suppressor 10 according to one embodiment of the present invention, and FIG. 2 provides a side cross-section view of the suppressor 10 shown in FIG. 1 taken along line 2-2. As shown in FIGS. 1 and 2, the suppressor 10 generally includes a casing 12 that contains the internal components of the suppressor 10 and provides the structure for connecting the suppressor 10 to the firearm. For convention, a rear end 14 of the casing 12 refers to the end of the casing 12 that connects to the firearm, and a front end 16 of the casing 12 refers to the opposite end of the casing 12 from which a bullet or other projectile exits.

The rear end 14 of the casing 12 generally includes means 18 for releasably attaching the suppressor 10 to the firearm. The function of the means 18 is to connect or disconnect the suppressor 10 to the firearm. The structure for performing this function may include any combination of compression fittings, threaded fittings, quick release connectors, clamps, latches, hasps, or other well-known mechanical devices suitable for releasably coupling one component to another. The front end 16 of the casing 12 generally terminates in an opening 20 through which the bullet or other projectile from the firearm passes. The casing 12 may further include various textured surfaces 22 between the rear and front ends 14, 16 to facilitate handling and gripping the suppressor 10.

As shown in FIG. 2, the casing 12 generally defines a longitudinal axis 24 for the suppressor 10 and contains the internal components of the suppressor 10. The casing 12 and internal components of the suppressor 10 may be constructed from any material suitable for exposure to the pressures and temperatures normally associated with the discharge of a firearm. For example, in particular embodiments, the casing 12 and internal components of the suppressor 10 may be constructed from metal, fiberglass, carbon, polymers, or other composite materials known in the art. The casing 12 is typically cylindrical, although the particular geometry of the casing 12 is not a limitation of the present invention unless specifically recited in the claims.

In the particular embodiment shown in FIG. 2, the suppressor 10 generally includes a rear baffle stack support assembly 26, a baffle stack assembly 28, and a front baffle stack support assembly 30. The rear baffle stack support assembly 26 generally includes structure for connecting the suppressor 10 to the firearm, as well as structure for preconditioning the combustion gases upstream of the baffle stack assembly 28. The baffle stack assembly 28 generally includes a series of baffles 32 in a stacked relationship to further cool and reduce the energy of the combustion gases. For example, as shown in FIG. 2, the baffle stack assembly 28 may include five baffles 32 sequentially stacked together. The front baffle stack support assembly 30 generally holds the baffles 32 in place and provides expansion capability so additional baffles 32 may be added to the baffle stack assembly 28 if desired.

Figure 3:
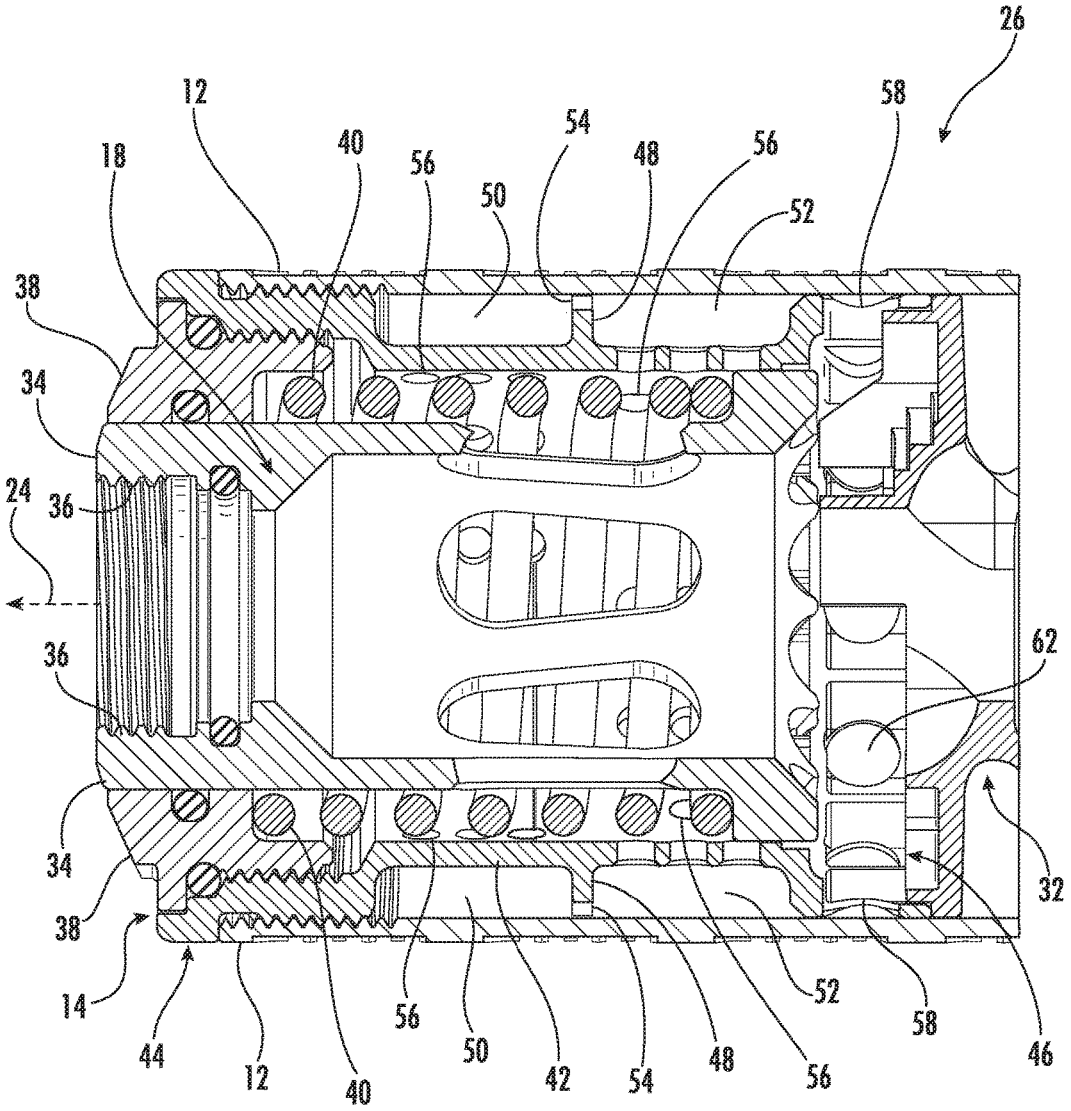
FIG. 3 is an enlarged view of the rear baffle stack support assembly shown in FIG. 2.

FIG. 3 provides an enlarged view of the rear baffle stack support assembly 26 shown in FIG. 2. In this particular embodiment, the means 18 for releasably attaching the suppressor 10 to the firearm includes an adaptor 34 with female threads 36 located at the rear end 14 of the casing 12. As shown in FIG. 3, the means 18 may optionally include a fitting 38 connected to the casing 12 and a spring 40 operably engaged between the adaptor 34 and the fitting 38. In this manner, the spring 40 may bias the adaptor 34 away from the fitting 38 and into the casing 12, while allowing the adaptor 34 to slide axially with respect to the fitting 38 to facilitate threading the adaptor 34 onto complementary male threads on the firearm.

As shown in FIG. 3, the rear baffle stack support assembly 26 includes a cylindrical support 42 aligned with the longitudinal axis 24 of the casing 12. The cylindrical support 42 has an upstream end 44 connected to the casing 12. For example, as shown in FIG. 3, the upstream end 44 of the cylindrical support 42 may be threaded into the rear end 14 of the casing 12 to facilitate assembly of internal components in the suppressor 10. The cylindrical support 42 also has a downstream end 46 engaged with the most upstream baffle 32 in the baffle stack assembly 28. In this manner, the cylindrical support 42 is attached to the casing 12 and extends axially to the most upstream baffle 32 in the baffle stack assembly 28 to provide axial support to the baffles 32.

The structural features of the cylindrical support 42 will be described in more detail with reference to FIGS. 4-6 which provide a front perspective view, a side plan view, and a front plan view, respectively, of the cylindrical support 42 according to one embodiment of the present invention. As shown most clearly in FIGS. 4 and 5, a circumferential rib 48 surrounds the cylindrical support 42 and extends radially from the cylindrical support 48 to the casing 12. As a result, as shown most clearly in FIG. 3, the casing 12, cylindrical support 42, and circumferential rib 48 define an upstream annular chamber 50 and a downstream annular chamber 52. The upstream and downstream annular chambers 50, 52 circumferentially surround the cylindrical support 42 to provide volumes in which the combustion gases may expand and cool. Particular embodiments may further include a plurality of passages 54 between the circumferential rib 48 and the casing 12 to provide fluid communication between the upstream and downstream annular chambers 50, 52. This fluid communication allows the pressure between the upstream and downstream annular chambers 50, 52 to equalize more readily.

Figure 4:
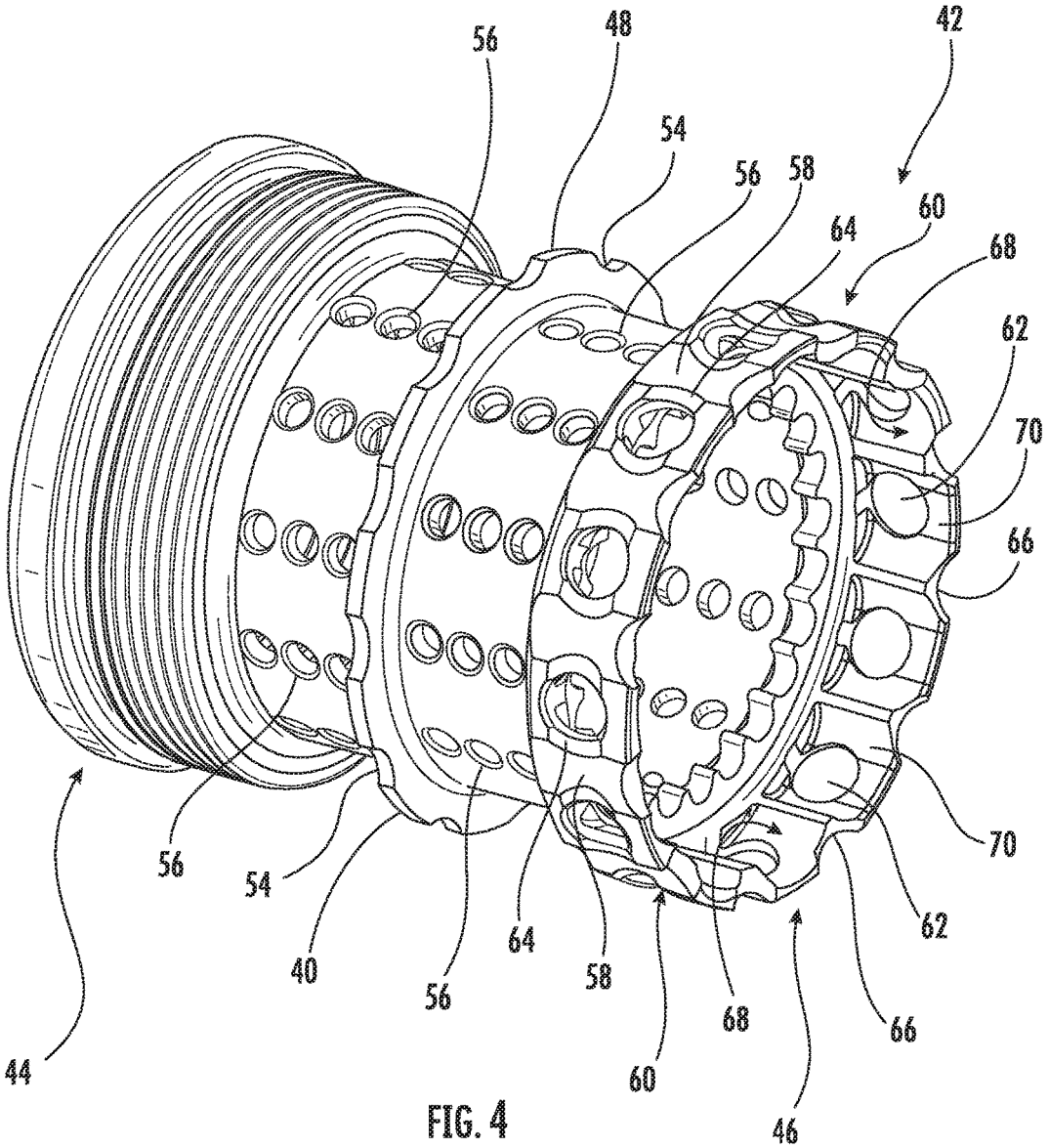
FIG. 4 is a front perspective view of a cylindrical support according to one embodiment of the present invention.
Figure 5:
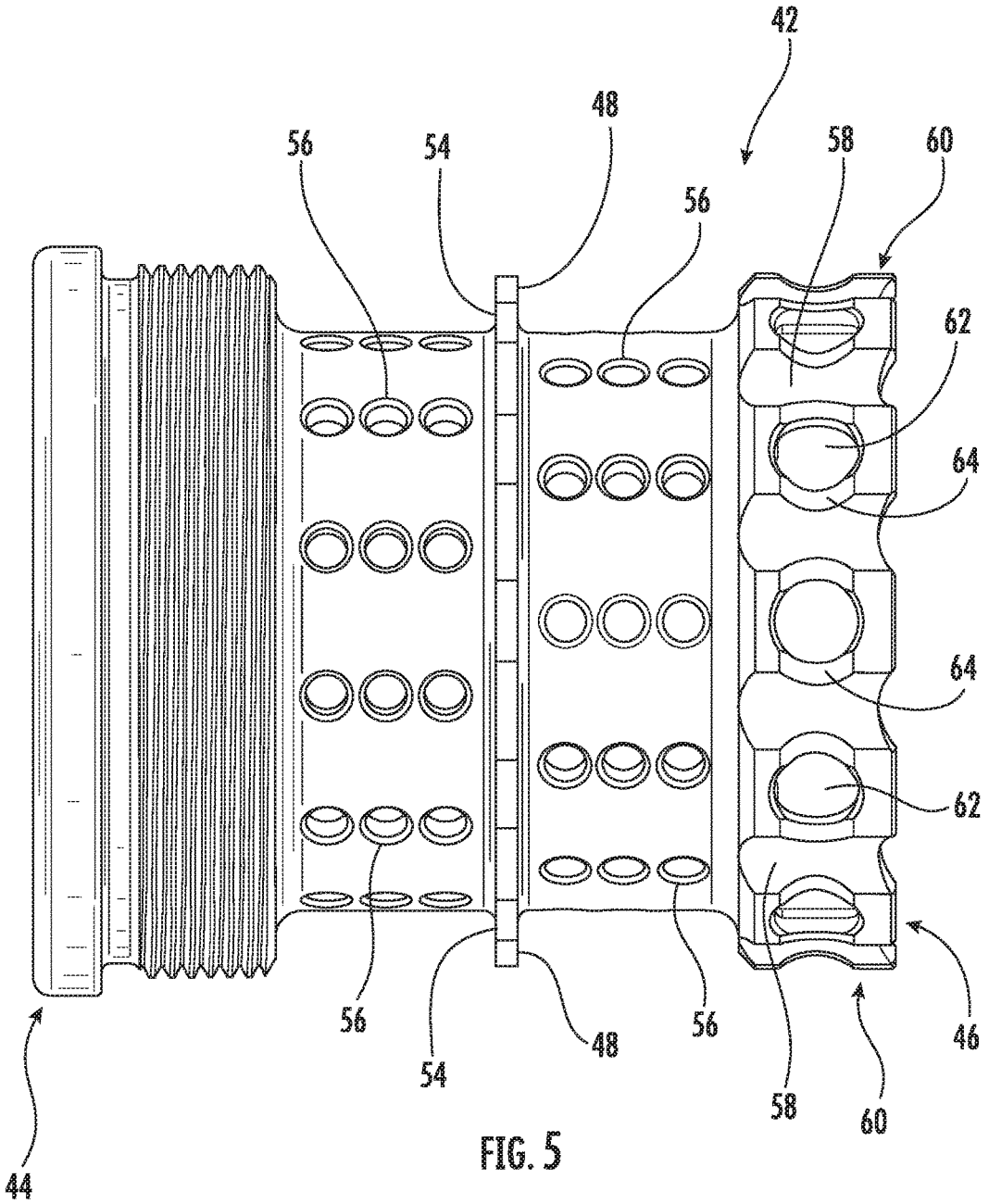
FIG. 5 is a side plan view of the cylindrical support shown in FIG. 4.
Figure 6:
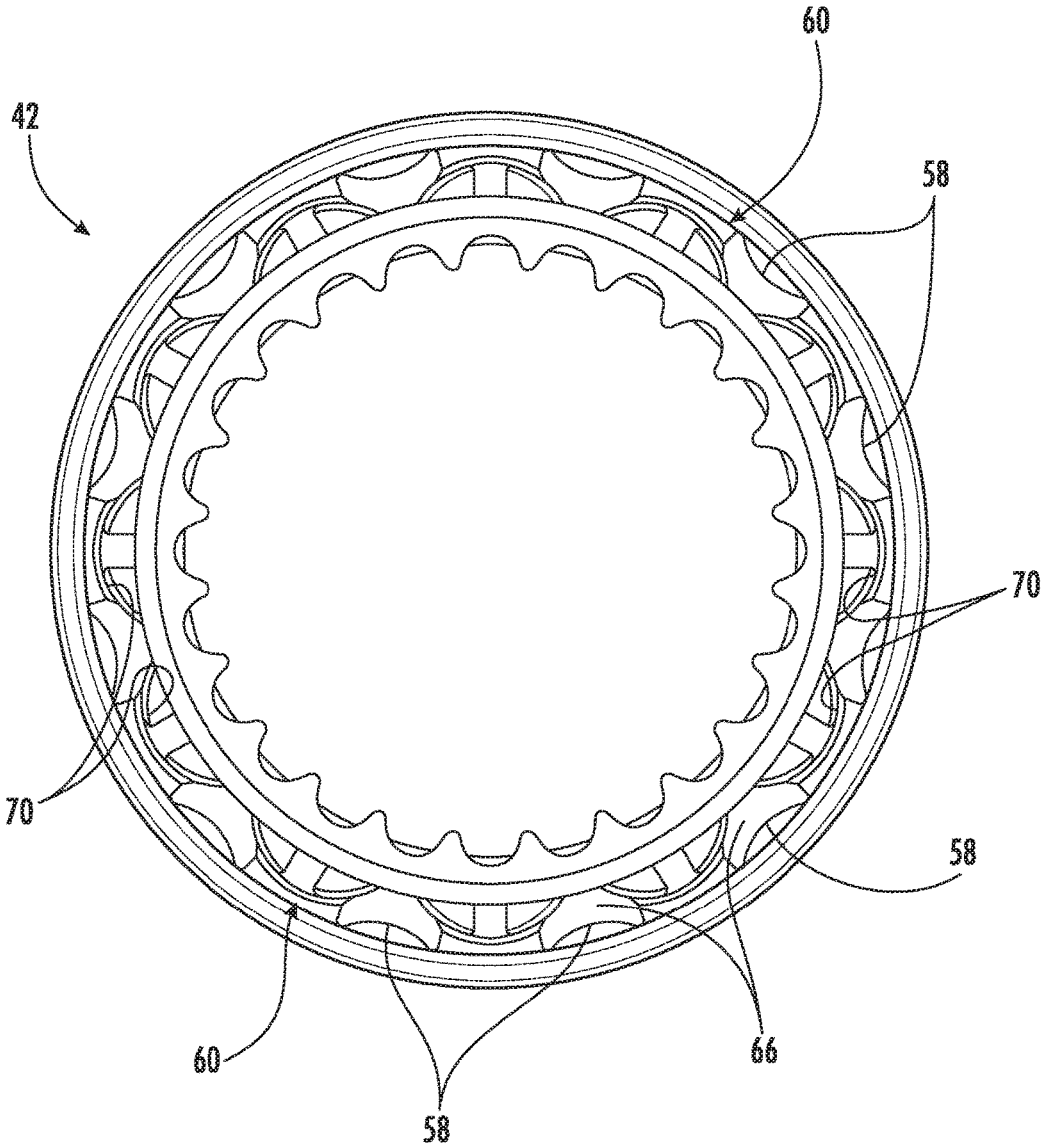
FIG. 6 is a front plan view of the cylindrical support shown in FIG. 4.

As shown in FIGS. 2-5, a plurality of apertures 56 through the cylindrical support 42 provide fluid communication through the cylindrical support 42 to the upstream and downstream annular chambers 50, 52. In this manner, the cylindrical support 42 pre-conditions flow of the combustion gases before reaching the baffle stack assembly 28 by allowing the combustion gases to flow through the apertures 56 and into the upstream and downstream annular chambers 50, 52 where the combustion gases may expand and cool. In particular embodiments, as shown in FIGS. 4 and 5, the apertures 56 upstream from the circumferential rib 48 may be circumferentially offset from the apertures 56 downstream from the circumferential rib 48 to further enhance distribution of the combustion gases to the respective upstream and downstream annular chambers 50, 52.

FIGS. 4 and 5 most clearly illustrate additional optional features of the downstream end 46 of the cylindrical support 42 that provide additional pre-conditioning of the combustion gases before reaching the baffle stack assembly 28. As shown in FIGS. 4 and 5, a plurality of axially extending grooves 58 may be disposed circumferentially around an outer surface 60 of the downstream end 46 of the cylindrical support 42. As shown in FIG. 3, the axially extending grooves 58 provide fluid communication from the downstream annular chamber 52 between the outer surface 60 of the downstream end 46 of the cylindrical support 42 and the casing 12.

As shown in FIGS. 4 and 5, particular embodiments may further include a plurality of holes 62 through the downstream end 46 of the cylindrical support 42 and a plurality of circumferentially extending grooves 64 disposed circumferentially around the outer surface 60 of the downstream end 46 of the cylindrical support 42. The circumferentially extending grooves 64 provide fluid communication between the axially extending grooves 58 and the holes 62. In this manner, the tortuous flow of combustion gases through the axially extending grooves 58, circumferentially extending grooves 64, and holes 62 provide additional alternative flow paths for the combustion gases before reaching the baffle stack assembly 28.

Particular embodiments may also include a plurality of radially extending grooves 66 in the downstream end 46 of the cylindrical support 42. The radially extending grooves 66 may be circumferentially arranged around the downstream end 46 of the cylindrical support 42 to coincide with the axially extending grooves 58.

The downstream end 46 of the cylindrical support 42 may abut the most upstream baffle 32 to support the baffle stack assembly 28 axially. Alternately, as shown in FIG. 4, an inner surface 68 of the downstream end 46 of the cylindrical support 42 may include a plurality of axially extending grooves 70. The axially extending grooves 70 may be disposed circumferentially around the inner surface 68. In this manner, the axially extending grooves 70 may engage with a complementary surface of the most upstream baffle 32 to not only provide axial support to the baffle stack assembly 28, but to also provide circumferential indexing of the most upstream baffle 28.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A suppressor for a firearm, comprising:

a casing;

a plurality of baffles inside said casing;

means for releasably attaching said suppressor to the firearm;

a cylindrical support having an upstream end connected to said casing and a downstream end engaged with at least one baffle of the plurality of baffles;

a circumferential rib integrally connected to said cylindrical support, wherein said circumferential rib surrounds and extends radially from said cylindrical support;

an upstream annular chamber upstream from said circumferential rib and defined at least in part by said casing, said cylindrical support, and said circumferential rib, wherein said upstream annular chamber circumferentially surrounds said cylindrical support;

a downstream annular chamber downstream from said circumferential rib and defined at least in part by said casing, said cylindrical support, and said circumferential rib, wherein said downstream annular chamber circumferentially surrounds said cylindrical support downstream from said upstream annular chamber;

a first plurality of apertures through said cylindrical support upstream from said circumferential rib that provide fluid communication through said cylindrical support to said upstream annular chamber; and a second plurality of apertures through said cylindrical support downstream from said circumferential rib that provide fluid communication through said cylindrical support to said downstream annular chamber.

2. The suppressor as in claim 1, further comprising a plurality of passages between said circumferential rib and said casing, wherein said plurality of passages provide fluid communication between said upstream and downstream annular chambers.

3. The suppressor as in claim 1, wherein said first plurality of apertures through said cylindrical support upstream from said circumferential rib are circumferentially offset from said second plurality of apertures through said cylindrical support downstream from said circumferential rib.

4. The suppressor as in claim 1, further comprising a plurality of axially extending grooves disposed circumferentially around an outer surface of said downstream end of said cylindrical support, wherein said plurality of axially extending grooves provide fluid communication from said downstream annular chamber.

5. The suppressor as in claim 4, further comprising a plurality of holes through said downstream end of said cylindrical support and a plurality of circumferentially extending grooves disposed circumferentially around said outer surface of said downstream end of said cylindrical support, wherein said plurality of circumferentially extending grooves provide fluid communication between said plurality of axially extending grooves and said plurality of holes.

6. The suppressor as in claim 1, further comprising a plurality of radially extending grooves in said downstream end of said cylindrical support.

7. The suppressor as in claim 1, further comprising a plurality of axially extending grooves disposed circumferentially around an inner surface of said downstream end of said cylindrical support, wherein said plurality of axially extending grooves engage with at least one baffle of the plurality of baffles.

8. A suppressor for a firearm, comprising:

a casing having a rear end disposed opposite from a front end;

a plurality of baffles inside said casing between said rear and front ends;

a cylindrical support having an upstream end, a downstream end, and a circumferential rib, wherein said upstream end is connected to said rear end of said casing, said downstream end is engaged with at least one baffle of the plurality of baffles, and said circumferential rib is integrally connected to said cylindrical support and surrounds said cylindrical support between said upstream and downstream ends and extends radially from said cylindrical support to said casing;

an upstream annular chamber upstream from said circumferential rib and defined at least in part by said casing, said cylindrical support, and said circumferential rib, wherein said upstream annular chamber circumferentially surrounds said cylindrical support;

a downstream annular chamber downstream from said circumferential rib and defined at least in part by said casing, said cylindrical support, and said circumferential rib, wherein said downstream annular chamber circumferentially surrounds said cylindrical support downstream from said upstream annular chamber;

a first plurality of apertures through said cylindrical support upstream from said circumferential rib that provide fluid communication through said cylindrical support to said upstream annular chamber; and a second plurality of apertures through said cylindrical support downstream from said circumferential rib that provide fluid communication through said cylindrical support to said downstream annular chamber.

9. The suppressor as in claim 8, further comprising a plurality of passages between said circumferential rib and said casing, wherein said plurality of passages provide fluid communication between said upstream and downstream annular chambers.

10. The suppressor as in claim 8, wherein said first plurality of apertures through said cylindrical support upstream from said circumferential rib are circumferentially offset from said second plurality of apertures through said cylindrical support downstream from said circumferential rib.

11. The suppressor as in claim 8, further comprising a plurality of axially extending grooves disposed circumferentially around an outer surface of said downstream end of said cylindrical support, wherein said plurality of axially extending grooves provide fluid communication from said downstream annular chamber to said plurality of baffles.

12. The suppressor as in claim 11, further comprising a plurality of holes through said downstream end of said cylindrical support and a plurality of circumferentially extending grooves disposed circumferentially around said outer surface of said downstream end of said cylindrical support, wherein said plurality of circumferentially extending grooves provide fluid communication between said plurality of axially extending grooves and said plurality of holes.

13. The suppressor as in claim 8, further comprising a plurality of radially extending grooves in said downstream end of said cylindrical support.

14. The suppressor as in claim 8, further comprising a plurality of axially extending grooves disposed circumferentially around an inner surface of said downstream end of said cylindrical support, wherein said plurality of axially extending grooves engage with at least one baffle of the plurality of baffles.

15. A suppressor for a firearm, comprising:

a casing having a rear end disposed opposite from a front end;

a plurality of baffles inside said casing between said rear and front ends;

a cylindrical support having an upstream end, a downstream end, and a circumferential rib, wherein said upstream end is connected to said rear end of said casing, said downstream end is engaged with at least one baffle of the plurality of baffles, and said circumferential rib surrounds said cylindrical support between said upstream and downstream ends and extends radially from said cylindrical support to said casing;

an upstream annular chamber upstream from said circumferential rib and defined at least in part by said casing, said cylindrical support, and said circumferential rib, wherein said upstream annular chamber circumferentially surrounds said cylindrical support;

a downstream annular chamber downstream from said circumferential rib and defined at least in part by said casing, said cylindrical support, and said circumferential rib, wherein said downstream annular chamber circumferentially surrounds said cylindrical support downstream from said upstream annular chamber;

a first plurality of apertures through said cylindrical support upstream from said circumferential rib that provide fluid communication through said cylindrical support to said upstream annular chamber;

a second plurality of apertures through said cylindrical support downstream from said circumferential rib that provide fluid communication through said cylindrical support to said downstream annular chamber a plurality of passages between said circumferential rib and said casing, wherein said plurality of passages provide fluid communication between said upstream and downstream annular chambers; and a plurality of axially extending grooves disposed circumferentially around an outer surface of said downstream end of said cylindrical support, wherein said plurality of axially extending grooves provide fluid communication from said downstream annular chamber to said plurality of baffles.

16. The suppressor as in claim 15, wherein said first plurality of apertures through said cylindrical support upstream from said circumferential rib are circumferentially offset from said second plurality of apertures through said cylindrical support downstream from said circumferential rib.

17. The suppressor as in claim 15, further comprising a plurality of holes through said downstream end of said cylindrical support and a plurality of circumferentially extending grooves disposed circumferentially around said outer surface of said downstream end of said cylindrical support, wherein said plurality of circumferentially extending grooves provide fluid communication between said plurality of axially extending grooves and said plurality of holes.

18. The suppressor as in claim 15, further comprising a plurality of radially extending grooves in said downstream end of said cylindrical support.

19. The suppressor as in claim 15, further comprising a plurality of axially extending grooves disposed circumferentially around an inner surface of said downstream end of said cylindrical support, wherein said plurality of axially extending grooves engage with at least one baffle of the plurality of baffles.

* * * * *